US009242453B2

(12) United States Patent
Baumgarten et al.

(10) Patent No.: US 9,242,453 B2
(45) Date of Patent: Jan. 26, 2016

(54) METHOD FOR COMPENSATING DEFLECTION OF AN INK FOUNTAIN IN PRINTING PRESSES

(75) Inventors: Sven Baumgarten, Berlin (DE); Sebastian Krüger, Stuttgart (DE); Martin Mayer, Ladenburg (DE); Bernhard Roskosch, Wiesloch (DE); Rolf Spilger, Viernheim (DE)

(73) Assignee: HEIDELBERGER DRUCKMASCHINEN, Heidelberg (DE)

( * ) Notice: Subject to any disclaimer, the term of this patent is extended or adjusted under 35 U.S.C. 154(b) by 260 days.

(21) Appl. No.: 13/405,740

(22) Filed: Feb. 27, 2012

(65) Prior Publication Data

US 2012/0216692 A1 Aug. 30, 2012

(30) Foreign Application Priority Data

Feb. 26, 2011 (DE) ..... 10 2011 012 885

(51) Int. Cl.
*B41F 31/04* (2006.01)

(52) U.S. Cl.
CPC ..... *B41F 31/045* (2013.01); *B41P 2233/11* (2013.01); *B41P 2233/30* (2013.01)

(58) Field of Classification Search
CPC .... B41F 31/045; B41F 31/04; B41F 33/0045; B41F 33/0027; B41P 2233/30; B41P 2233/11
USPC ..... 101/364, 365, DIG. 47
See application file for complete search history.

(56) References Cited

U.S. PATENT DOCUMENTS

| | | | | |
|---|---|---|---|---|
| 4,058,058 | A * | 11/1977 | Hantscho | 101/365 |
| 4,391,192 | A * | 7/1983 | Wieland | 101/351.3 |
| 5,113,762 | A * | 5/1992 | Abendroth et al. | 101/352.09 |
| 6,073,557 | A * | 6/2000 | Hachiya et al. | 101/365 |
| 6,116,161 | A * | 9/2000 | Voge et al. | 101/483 |
| 7,121,208 | B2 | 10/2006 | Gateaud et al. | |
| 2007/0181023 | A1 | 8/2007 | Baertschi et al. | |
| 2010/0064922 | A1 * | 3/2010 | Elter et al. | 101/484 |
| 2011/0100242 | A1 * | 5/2011 | Krueger et al. | 101/365 |

FOREIGN PATENT DOCUMENTS

| | | | |
|---|---|---|---|
| CN | 1502467 | A | 6/2004 |
| CN | 1749005 | A | 3/2006 |
| CN | 1946555 | A | 4/2007 |
| CN | 101279531 | A | 10/2008 |

(Continued)

OTHER PUBLICATIONS

Oberg, et al., Machinery's Handbook, 2000, Industrial Press, Inc., 26th Edition, pp. 236-240.*

(Continued)

*Primary Examiner* — Daniel J Colilla
*Assistant Examiner* — Leo T Hinze
(74) *Attorney, Agent, or Firm* — Laurence Greenberg; Werner Stemer; Ralph Locher

(57) ABSTRACT

A method for adjusting ink zone openings in an ink fountain of a printing press uses a computer. The computer calculates a deflection of the ink fountain on the basis of an ink fountain model which contains forces that act on the ink fountain, and takes the calculated deflection of the ink fountain into consideration during the adjustment of the ink zone openings.

8 Claims, 3 Drawing Sheets

(56) References Cited

FOREIGN PATENT DOCUMENTS

| | | | |
|---|---|---|---|
| CN | 101973163 | A | 2/2011 |
| DE | 33 25 005 | A1 | 5/1984 |
| DE | 10 2009 045 559 | A1 | 4/2011 |
| GB | 2 073 671 | A1 | 10/1981 |
| JP | 2001-138489 | A | 5/2001 |

OTHER PUBLICATIONS

Gere, et al., Mechanics of Materials, 1990, PWS-Kent Publishing Company, 3rd Edition, p. xi.*

German Patent and Trademark Office Search Report, Dated Nov. 9, 2011.

* cited by examiner

METHOD FOR COMPENSATING DEFLECTION OF AN INK FOUNTAIN IN PRINTING PRESSES

CROSS-REFERENCE TO RELATED APPLICATION

This application claims the priority, under 35 U.S.C. §119, of German Patent Application DE 10 2011 012 885.9, filed Feb. 26, 2011; the prior application is herewith incorporated by reference in its entirety.

BACKGROUND OF THE INVENTION

Field of the Invention

The present invention relates to a method for compensating for a deflection of an ink fountain in printing presses by adjusting an opening of ink zones in the ink fountain using a computer. Every printing unit in offset printing presses has an inking unit which supplies the associated printing unit with ink. The ink provided therein has to be metered in such a way that printed materials which are produced by way of the printing press correspond to a printing original. For that purpose, the inking units usually have an ink fountain with a plurality of ink zones which can be opened to a different extent, in order for it to be possible to meter the ink in a targeted manner over the entire printing material width. According to a frequently used construction of the ink fountain, ink zone slides are pressed against a rotating ductor roll, in order to make the ink metering possible. The ink quantity for each ink zone is thus set by the size of an ink metering gap between the ductor roll and the ink zone slide. Deflections of the ink fountain which lead to a slightly larger metering opening between the ink zone slide and the ductor result from a limited mechanical rigidity of the ink fountain and the ductor as well as damping properties of the ink zone slide. That leads to a greater quantity of ink being dispensed than is to be expected according to setpoint values and settings of the ink zone slides.

The problems caused by the effects of the deflection of the ink fountain on the ink metering behavior in the inking unit in printing presses, is known from Patent Abstracts of Japan No. 2001138489 A. That document proposes a method, by way of which the deflection of the ink fountain can be corrected. In that case, the deflections are determined experimentally in the printing press and are stored in a computer of the printing press. The operator of the printing press can then manually select corresponding correction values for the deflection. In that case, the ratio between the pressure of the ink zone slides and the deflection is stored.

That method has the great disadvantage that the operator of the printing press has to manually input correction values, and the correction values are stored only as a function of a parameter, namely the pressure of the ink zone slide. Since, however, the deflection of the ink fountain in the printing press can have many causes, the proposed method does not make a precise and, above all, automatic correction of the deflection of the ink fountain on the ink metering possible. Since the ink metering concerns small ink metering openings in the range of micrometers and the deflection of the ink fountain likewise lies in that small range, the correction method according to the prior art does not provide a process which can be managed in practice.

SUMMARY OF THE INVENTION

It is accordingly an object of the invention to provide a method for compensating for a deflection of an ink fountain in printing presses by adjusting an opening of ink zones, which overcomes the hereinafore-mentioned disadvantages of the heretofore-known methods of this general type and which allows a reliable and automatic correction of the ink zone openings using a computer, with the deflection of the ink fountain being taken into consideration.

With the foregoing and other objects in view there is provided, in accordance with the invention, a method for adjusting ink zone openings in an ink fountain of a printing press using a computer. The method comprises using the computer to calculate a deflection of the ink fountain based on an ink fountain model containing forces acting on the ink fountain and to take the calculated deflection of the ink fountain into consideration during the adjustment of the ink zone openings.

The method according to the invention for adjusting the opening of ink zones in the ink fountain of printing presses substantially includes an ink fountain model which is realized as software on a control computer of the printing press. The ink fountain model is a mathematical model which takes as many influences as possible which lead to the deflection of the ink fountain into consideration and calculates the suitable correction values for compensating for the deflection of the ink fountain as a function of the respective print job and operating state of the printing press. First of all, the suitable ink zone openings in the ink fountain for achieving the setpoint coloring of the printing original are calculated for each print job as a function of the coloring of the printing original. In addition, based on the ink fountain model, the deflection of the ink fountain is calculated on the basis of the data of the print job and the operating parameters of the printing press such as temperature, rotational speed, etc. After the calculation of the deflection of the ink fountain, correction values for the ink zone openings are then calculated, which correction values are in turn superimposed on the ink zone openings calculated on the basis of the coloring of the printing original, in order to set the setpoint coloring. In this way, the computer calculates the corrected ink zone openings on the basis of the ink fountain model, by way of which corrected ink zone openings the setpoint coloring which is predefined by the printing original is also actually achieved when the ink fountain is deflected.

In accordance with another mode of the invention, the computer calculates the deflection of the ink fountain over a plurality of print jobs. This refinement of the invention ensures that as many effects as possible over various print jobs are incorporated in the calculation of the deflection of the ink fountain and it is thus also taken into consideration that the slight deflections of the ink fountain are not reversible again directly from one print job to the other, but rather slowly decrease or possibly even increase over a plurality of print jobs.

In accordance with a further mode of the invention, the computer calculates the zonal metering force of the settings of the ink zone openings for each ink zone. On the basis of the coloring of the printing original, the computer first of all calculates the suitable ink zone opening for each ink zone and the setpoint coloring is achieved with that suitable ink zone opening. The computer then determines the metering force for each ink zone in a manner appropriate to the ink zone opening. The metering force is the cause of the deflection of the ink fountain. The zonal metering force is in turn calculated on the basis of the ink fountain model. In this case, the ink fountain model takes into consideration, in particular, the inking profile of the respective print job, the rotational speed of the ductor roll, the viscosity of the ink of the current print job, and also the entirety over a plurality of print jobs. Further criteria are the setpoint ink zone openings on the basis of the setpoint inking or the temperature of the printing press. Characteristic curves can be stored in the computer of the printing press for all of these parameters. The computer can access the characteristic curves in the context of the ink fountain model in order to calculate the deflection of the ink fountain. In addition, the mechanical rigidity of the ink fountain and of the ductor roll is also incorporated into the ink fountain model. The change in the ink zone openings, which is conditional on the deflection, can then be calculated from the forces which are calculated in this way. The change in the ink zone openings is then superimposed on the setpoint values.

In accordance with an added mode of the invention, it is moreover provided that, during the setting of the ink zone openings, the computer first of all moves the ink zone with the largest opening and then that one with the smallest opening, starting from the starting position of the ink zone openings. This procedure serves to avoid collisions of the ink zones and the ductor which are induced by the deflection of the ink fountain. To this end, the adjusting movements of the ink zone slides are coordinated with respect to time.

The individual parameters which are taken into consideration for calculating the ink zone openings can be derived partially from the data of the print job or can be detected by sensors such as temperature sensors, etc. In particular, the viscosity of the ink can also be input into the computer by the operator. The method according to the invention can be used for every setting of the ink zones, whether for ink presetting, for speed compensation, for regulating the ink or when doctoring off the ductor for cleaning.

In accordance with a concomitant mode of the invention, the computer detects additional correction adjustments of the ink zone openings by a printer and takes the additional correction adjustments into consideration during the calculation of future adjustments of ink zone openings. In this way, additional manual corrections by the printer are detected, since the difference between computationally determined setpoint values and actual values is detected, and it is by way of the actual values that the printer actually prints the run. The detection of the manual corrections is interesting because this is the only feedback about whether the printer is satisfied with the result of the model, or whether he or she has to make additional manual corrections. It is the aim to reduce the manually corrected deviations on average to 0, with the result that as many positive as negative positional deviations occur. The model can therefore learn autonomously and anticipate correction work by the printer.

The great advantage of the present invention includes the fact that no additional device outlay is required in the form of measuring technology or additional actuating elements. The ink fountain model is determined as a one-off in advance at the manufacturer for every ink fountain type, with the result also that no additional time is required to be spent at the customer or during installation of the printing unit. In addition to the advantages which have already been mentioned, the method according to the invention also leads to increased wear being avoided in the case of inhomogeneous printing subjects. The present invention is suitable, in particular, for use in knife or blade-type ink fountains, but can also be used expediently in other zonal ink fountains.

Other features which are considered as characteristic for the invention are set forth in the appended claims.

Although the invention is illustrated and described herein as embodied in a method for compensating deflection of an ink fountain in printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
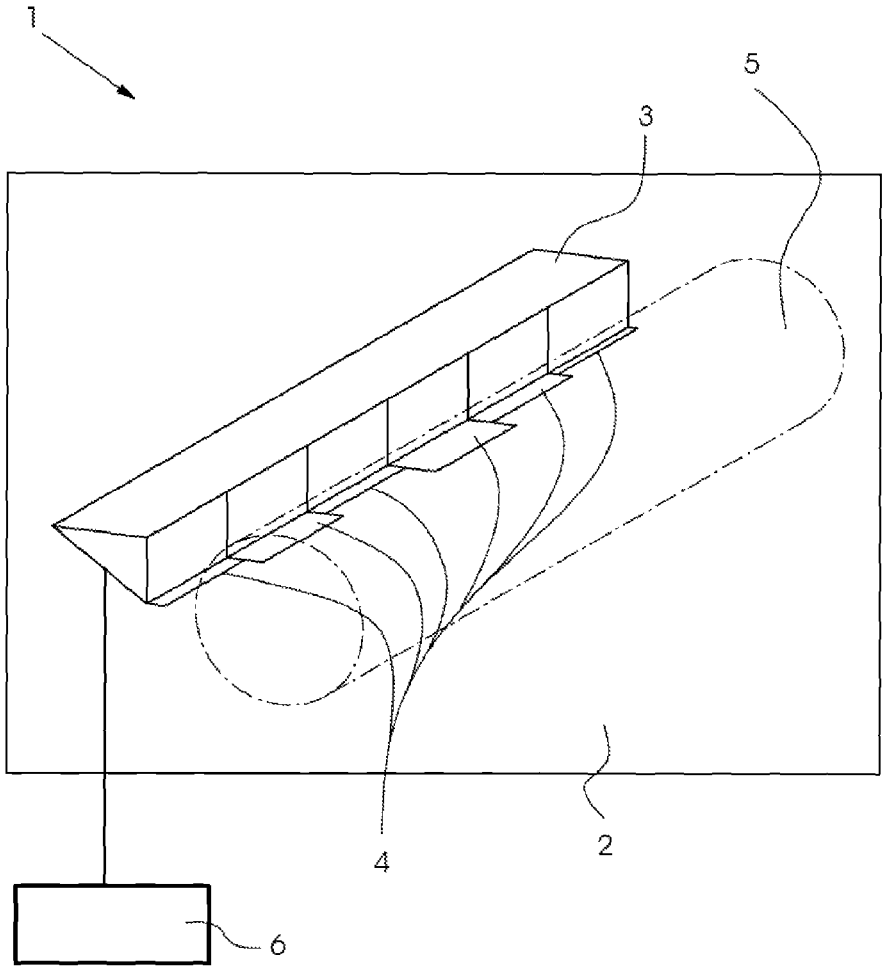
FIG. 1 is a diagrammatic perspective view of an ink fountain in a printing unit.

Referring now to the figures of the drawings in detail and first, particularly, to FIG. 1 thereof, there is seen a diagrammatic illustration of a printing unit 2 of a printing press 1, in which the printing unit 2 has an ink fountain 3 and an associated ductor roll 5 in the inking unit. Ink which is provided for the printing unit 2 and is metered in a gap between the ductor roll 5 and ink zone slides 4, is present in the ink fountain 3. In this case, the ink zone slides 4 are adjusted by non-illustrated electric drive motors, which are in turn connected to a computer 6. The computer 6 is the control computer of the printing press 1. The control computer 6 calculates all of the settings of the printing press 1 as a function of a respectively upcoming print job and sets them as far as possible in a fully automatic manner. To this end, the computer 6 first of all calculates appropriate ink zone openings of the ink zone slides 4 on the basis of the respective print job and associated printing subject and associated inking. Under ideal conditions, the ink zone openings which are calculated in this way would lead to setpoint coloring of the desired printing subject. However, forces between the ink zone slides 4 and the ductor roll 5 result in a deflection of the ink fountain 3 and in certain cases also of the ductor roll 5. That deflection leads to the openings of the ink zone slides 4 not corresponding to the predefined setpoint ink zone openings. That leads to more or less ink being metered in the inking unit than would be appropriate for the upcoming print job.

Figure 2:
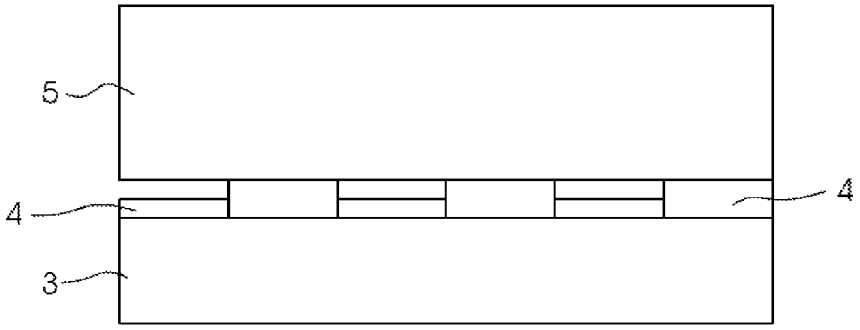
FIG. 2 is a top-plan view of a non-deflected ink fountain and an associated ductor roll.

FIG. 2 shows a plan view of the ink fountain 3 and the associated ductor roll 5 of FIG. 1. The ink zone slides 4 are open differently for each ink zone, with the result that the ink can be metered individually over the entire width of the printing material for each ink zone. The ideal state of the ink fountain and of the ductor 5 is depicted in FIG. 2.

Figure 3:
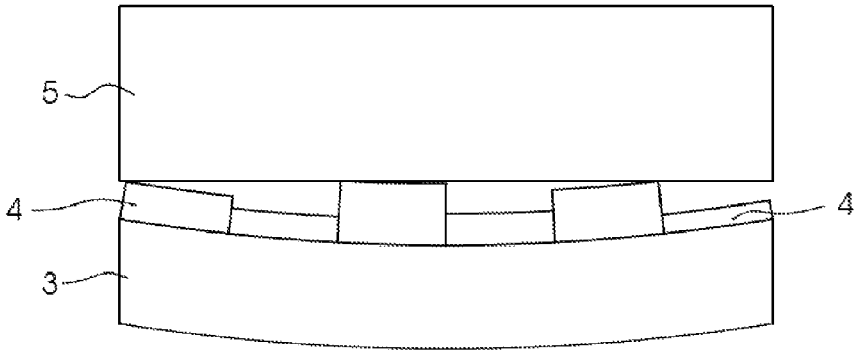
FIG. 3 is a top-plan view of a deflected ink fountain and an associated ductor roll.

However, as shown in FIG. 3, at least the ink fountain 3 has a deflection induced by the mechanical forces between the ink zone slide 4 and the ductor roll 5. The deflection is deliberately shown on an exaggerated scale in FIG. 3, in order for it to be possible to clarify the associated problems. It can be seen that the ink zone openings of the respective ink zone slides 4 change and, in particular, the gap between the ductor 5 and the ink fountain 3 is increased in FIG. 3 due to the deflection. This necessarily leads to a greater quantity of ink being dispensed than is intended by the calculated setpoint values of the ink zone openings. However, the inking of the printing material therefore changes and the printing material which is printed in the printing press 1 no longer corresponds to the printing original. Since, however, the prints and the printing original are to be identical as far as possible, corresponding correction measures have to be taken.

The method according to the invention serves the purpose of carrying out the correction measures. The method first of all provides for the use of an ink fountain model which takes into consideration parameters such as ductor rotational speed n, setpoint gap opening, ink viscosity and temperature and calculates corresponding correction values for each print job with further consideration of the setpoint coloring of the printing subject. The correction values are then in turn superimposed onto the setpoint ink zone opening in order to achieve the coloring of the printing original. The ink fountain model is realized as software on the computer 6 and includes substantially a force model which can be a regression model in the form $F=a_0+a1*V+A_2*FZ_{Soll}+A_3*FZ_{Soll*V}+\ldots$. Furthermore, a physical model or a family of characteristics can also be used. Some parameters, such as the ink viscosity, can also be input by the operator, in which the ink viscosity that is printed on the ink container is transferred by hand. The calculation of the deformation of the ink fountain 3 itself can take place through a beam model, transfer matrices or a finite element method. In this case, in order to avoid collisions, first of all the ink zone openings with the greatest opening first and those with the smallest ones last are moved, starting from an existing starting position. A move to the starting position itself occurs in the reverse order.

Figure 4:
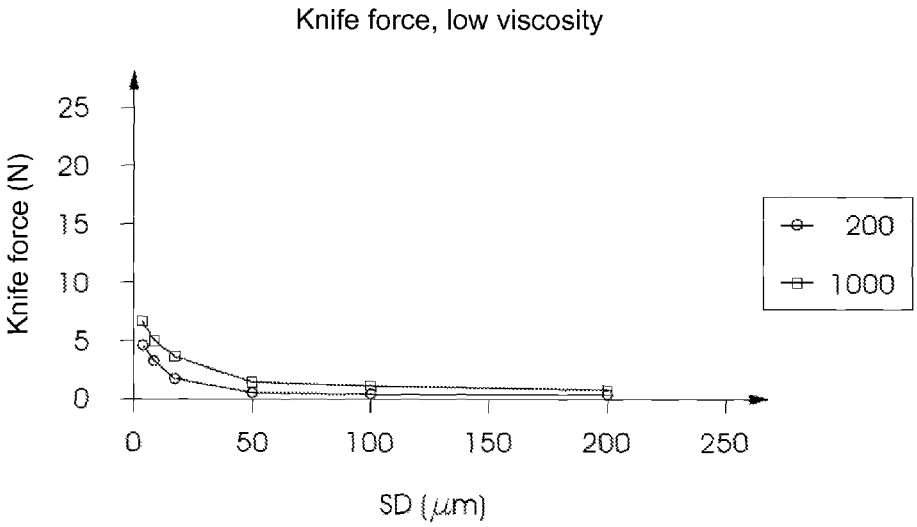
FIG. 4 is a diagram showing a force on ink zone slides as a function of a metered layer thickness at a low viscosity of printing ink.
Figure 5:
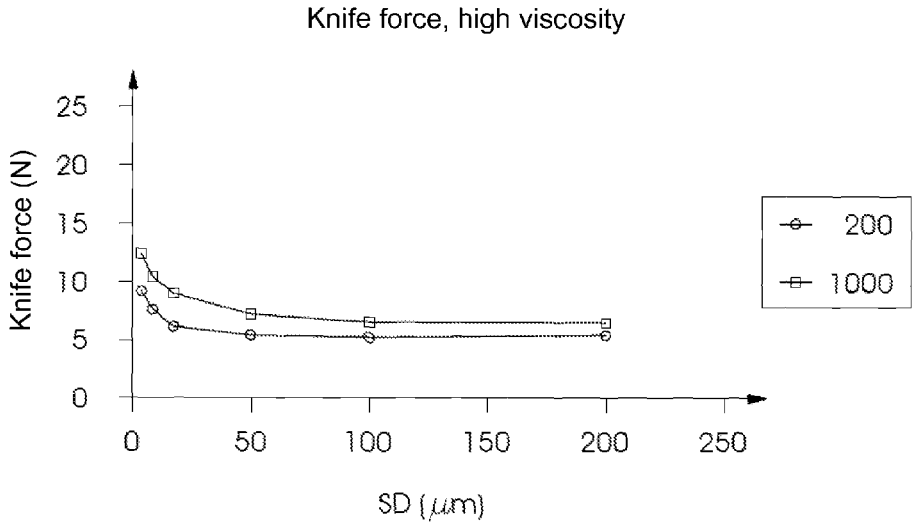
FIG. 5 is a further diagram showing the force on the ink zone slides as a function of the metered layer thickness at a high viscosity of the printing ink.

FIGS. 4 and 5 show simple models by way of example, which take the viscosity of the ink into consideration for the calculation of the force F of the ink zone slides. In this case, the force F on the ink zone slide is specified in Newtons in each case as a function of an ink layer thickness SD in micrometers, due to the setpoint coloring of the printing original. The characteristic curves are shown therein in each case for ductor rotational speeds n=200 and n=1000. This is therefore a simple ink fountain model, in which the force F on the ink zone slides is calculated using the viscosity and the rotational speed n of the ductor 5 with consideration of the ink layer thickness SD of the present print job. This ink fountain model can be extended in as complicated a way as possible, in order to take other parameters into consideration, such as the temperature, etc.

The great advantage of the present invention therefore lies in the fact that a correction of the deflection of the ink fountain takes place automatically and the operator merely has to input the data of the current print job and optionally also the data of the consumable materials which are used, such as the viscosity of the printing ink. As soon as the parameters which are taken into consideration in the ink fountain model are present, the calculation of the correction values takes place automatically without the assistance of the operator.

The invention claimed is:

1. A method for adjusting ink zone openings in an ink fountain of a printing press, the method comprising the following steps:

providing a computer, the computer calculating a deflection of the ink fountain based on an ink fountain model containing forces acting on the ink fountain;

the computer calculating correction values for the ink zone openings based on the calculated deflection of the ink fountain;

the computer correcting setpoint ink zone openings calculated for a print job by way of the correction values; and during setting of the ink zone openings, the computer first moving the ink zones with largest openings and then moving the ink zones with smallest openings, starting from a starting position of the ink zone openings.

2. The method according to claim 1, which further comprises calculating the deflection of the ink fountain over a plurality of print jobs, with the computer.

3. The method according to claim 1, which further comprises calculating a zonal metering force of an ink zone opening setting for each ink zone, with the computer.

4. The method according to claim 3, which further comprises calculating the zonal metering force, with the computer, based on an inking profile, a rotational speed of a ductor or a viscosity of ink of a current print job or of a plurality of print jobs.

5. The method according to claim 1, which further comprises storing characteristic curves for operating parameters of the inking unit, in the computer.

6. The method according to claim 5, which further comprises selecting the characteristic curves as an inking profile, a rotational speed of a ductor or a viscosity of ink.

7. The method according to claim 1, which further comprises taking a mechanical rigidity of the ink fountain and a ductor into consideration in the ink fountain model.

8. The method according to claim 1, which further comprises:

detecting additional correction adjustments of the ink zone openings by a printer, with the computer; and taking the additional correction adjustments into consideration, with the computer, during a calculation of future adjustments of ink zone openings.

* * * * *